US011255146B2

(12) United States Patent
Hawkins, III

(10) Patent No.: US 11,255,146 B2
(45) Date of Patent: Feb. 22, 2022

(54) PLUG ACTIVATED MECHANICAL ISOLATION DEVICE, SYSTEMS AND METHODS FOR CONTROLLING FLUID FLOW INSIDE A TUBULAR IN A WELLBORE

(71) Applicant: Drilling Innovative Solutions, LLC, Lafayette, LA (US)

(72) Inventor: Samuel P. Hawkins, III, Scott, LA (US)

(73) Assignee: DRILLING INNOVATIVE SOLUTIONS, LLC, Lafayette, LA (US)

( * ) Notice: Subject to any disclaimer, the term of this patent is extended or adjusted under 35 U.S.C. 154(b) by 162 days.

(21) Appl. No.: 16/625,418

(22) PCT Filed: Jun. 21, 2018

(86) PCT No.: PCT/US2018/038850
§ 371 (c)(1),
(2) Date: Dec. 20, 2019

(87) PCT Pub. No.: WO2018/237205
PCT Pub. Date: Dec. 27, 2018

(65) Prior Publication Data

US 2021/0324705 A1 Oct. 21, 2021

Related U.S. Application Data

(60) Provisional application No. 62/523,117, filed on Jun. 21, 2017.

(51) Int. Cl.
*E21B 34/06* (2006.01)
*E21B 34/14* (2006.01)
(Continued)

(52) U.S. Cl.
CPC ..... *E21B 23/03* (2013.01); *E21B 21/10* (2013.01); *E21B 33/134* (2013.01);
(Continued)

(58) Field of Classification Search
CPC .... E21B 34/063; E21B 34/142; E21B 33/134; E21B 33/16
See application file for complete search history.

(56) References Cited

U.S. PATENT DOCUMENTS 3,464,493 A 9/1969 Chancellor et al.
4,403,656 A * 9/1983 Ploeg ..... E21B 33/13 166/179

(Continued)

FOREIGN PATENT DOCUMENTS

CN 202325378 U 7/2012

OTHER PUBLICATIONS

International Search Report and Written Opinion of the International Searching Authority issued by the United States Patent & Trademark Office dated Sep. 12, 2018 in International Patent Application No. PCT/US2018/038850.

(Continued)

*Primary Examiner* — Cathleen R Hutchins
(74) *Attorney, Agent, or Firm* — Matthews, Lawson, McCutcheon & Joseph, PLLC

(57) ABSTRACT

Systems and methods include a plug activated mechanical isolation device that controls fluid flow inside a tubular in a wellbore. The device includes a sleeve for coupling to the tubular, and the sleeve includes an internal bore and port for fluid flow therethrough. A channel element is positioned in the internal bore and includes an internal channel and an orifice for fluid flow between the internal channel and internal bore. The channel element is attached to the sleeve via a breakable attachment portion, and the orifice is aligned (Continued)

with at least one port of the sleeve. The channel element is slidable within the sleeve, upon breakage of the breakable attachment portion with a force, to move the orifice out of alignment with the port of the sleeve so that a portion of the channel element covers the port of the sleeve to block fluid flow through the port.

20 Claims, 5 Drawing Sheets

(51) Int. Cl.

| | |
|---|---|
| ***E21B 33/134*** | (2006.01) |
| ***E21B 33/16*** | (2006.01) |
| ***E21B 23/03*** | (2006.01) |
| ***E21B 34/10*** | (2006.01) |
| ***E21B 21/10*** | (2006.01) |
| *E21B 21/08* | (2006.01) |

(52) U.S. Cl.
CPC ..... *E21B 34/063* (2013.01); *E21B 34/105* (2013.01); *E21B 34/14* (2013.01); *E21B 21/08* (2013.01); *E21B 33/16* (2013.01); *E21B 2200/04* (2020.05); *E21B 2200/05* (2020.05)

(56) References Cited

U.S. PATENT DOCUMENTS

| | | | | |
|---|---|---|---|---|
| 4,407,369 | A | 10/1983 | Hutchinson et al. | |
| 5,641,021 | A * | 6/1997 | Murray | E21B 21/103 166/291 |
| 6,769,490 | B2 | 8/2004 | Allamon et al. | |
| 8,225,859 | B1 | 7/2012 | Moidel | |
| 8,657,004 | B2 | 2/2014 | Zhou | |
| 2001/0045288 | A1 * | 11/2001 | Allamon | E21B 23/04 166/373 |
| 2010/0294503 | A1 | 11/2010 | Laurel et al. | |
| 2014/0224807 | A1 * | 8/2014 | Ramon | E21B 33/16 220/359.1 |

OTHER PUBLICATIONS

Office Action issued by the European Patent Office dated Nov. 5, 2021 in EP Patent Application No. 18820970.4 (9 pages).

* cited by examiner

PLUG ACTIVATED MECHANICAL ISOLATION DEVICE, SYSTEMS AND METHODS FOR CONTROLLING FLUID FLOW INSIDE A TUBULAR IN A WELLBORE

CROSS REFERENCE TO RELATED APPLICATIONS

This application claims priority to International Patent Application No. PCT PCT/US2018/038850, entitled "Plug Activated Mechanical Isolation Device, Systems and Method for Controlling Fluid Flow Inside a Tubular in a Wellbore", filed on Jun. 21, 2018, which claims priority to, and the benefit of, U.S. Provisional Application No. 62/523,117, entitled "Float Valve Systems", filed on Jun. 21, 2017. The disclosures of the prior applications are hereby incorporated by reference herein in their entireties.

FIELD

The present disclosure relates, generally, to a plug activated mechanical isolation device, systems and methods for controlling fluid flow inside a tubular in a wellbore. More particularly, the disclosure relates to a plug activated mechanical isolation device, systems and methods, which comprise installing the plug activated mechanical isolation device within a tubular at the surface and running the plug activated mechanical isolation device within the tubular or casing/liner into a wellbore. Once in the wellbore, a cementing procedure may be performed in which cement is pumped through the plug activated mechanical isolation device. Thereafter, the plug activated mechanical isolation device can be closed via pressure that moves components of the plug activated mechanical isolation device to prevent fluid flow through the plug activated mechanical isolation device.

BACKGROUND

The oil and gas industry has utilized one-way float valves for a variety of applications, including oil and gas wellbore operations. One such application is the use of float shoes and float collars, which are designed to prevent backflow of cement slurry into the annulus of a casing or other tubular string, and thereby enable the casing to "float" in the wellbore. Typically, these float shoes and float collars are attached to the end of a casing string and lowered into the wellbore during casing operations. However, this renders the float equipment vulnerable to a variety of problems, such as obstruction or deformation due to debris which is introduced to the float valve during circulation of mud or other drilling fluids. Additionally, unforeseen complications in downhole conditions may render other float equipment with, e.g., higher-strength materials or different designs more suited to cementing operations after the fact.

Further, conventional oil well cementing jobs involve pumping cement down the entire casing string, and out through the bottom of the casing string to fill the annulus adjacent the outer surface of the casing string. This cementing technique results in the need, once the cement has been pumped, for cleaning the inside of the casing string. Such a cleaning step requires an additional trip down the casing string with a cleaning tool. In addition, conventional cementing jobs require the use of a cement retainer or breech plug for sealing the casing and/or for performing negative testing on the casing. Placing such equipment downhole after the cementing and cleaning requires yet another trip down the casing string. Once the retainer or breech plug is in place, a pressure test device is sent through the casing string in a further trip. Additional steps, requiring even more trips down the casing string, include drilling out the cement retainer or breech plug, and then a second cleaning step of removing debris from the drilled out retainer or plug inside of the casing string.

There is thus a need for systems and methods that include a plug activated mechanical isolation device that can be positioned within the casing string before the casing string is lowered into the wellbore, and that can be manipulated with a plug sent into the casing string to close flow paths within the plug activated mechanical isolation device.

Embodiments of the plug activated mechanical isolation device, systems, and methods, disclosed herein, achieve this need.

SUMMARY

The present disclosure includes a plug activated mechanical isolation device, systems and methods for controlling fluid flow inside a tubular in a wellbore suitable for use in subterranean drilling. The mechanical isolation device, systems and methods provide an alternative to existing cement retainer equipment and processes by simplifying wellbore running procedures, increasing reliability of the barrier function, and reducing overall costs (e.g., by reducing the number of trips down the wellbore) of the well cementing process.

In embodiments of the present disclosure, the system including the plug activated mechanical isolation device may assume three functional positions. The first position of the system may be an "auto-fill" position (see FIG. 1) that allows well fluid to fill the casing string when the casing string (and accompanying plug activated mechanical isolation device) is being run within the wellbore. The second position of the system is a "pumping" position (see FIG. 3) in which the casing string locates the mechanical isolation device a desired depth for pumping cement, for example, through the mechanical isolation device and out through a bottom of the casing string. The third position of the system is a "closed" position (see FIG. 5), in which the pumping path in the second position is closed to prevent fluid flow through the mechanical isolation device.

In an embodiment of the present invention, a system for controlling fluid flow inside a tubular in a wellbore comprises: a tubular, a sleeve coupled to the tubular that includes an internal bore and at least one port for fluid flow therethrough, and a channel element positioned in the internal bore of the sleeve, so that the tubular, the sleeve and the channel element form a unit for insertion into the wellbore. The channel element can include an internal channel and an orifice for fluid flow between the internal channel and the internal bore of the sleeve, wherein the channel element can be attached to the sleeve via a breakable attachment portion, and the orifice can be aligned with the at least one port of the sleeve. The system can comprise a non-flow-through plug for lowering into the wellbore and the tubular and for exerting a force onto the channel element, wherein the force can break the attachment portion under a first predetermined pressure and can move the channel element relative to the sleeve to move the orifice out of alignment with the at least one port of the sleeve so that a portion of the channel element can cover the at least one port of the sleeve.

In an embodiment, the system can comprise a flow-through plug for lowering onto the channel element before the non-flow-through plug is lowered into the wellbore and the tubular. The flow-through plug can include a breakable part that breaks under a second predetermined pressure, that is less than the first predetermined pressure, to allow fluid flow through the flow-through plug and into the internal channel after the breakable part breaks, wherein the flow-through plug can be provided between the non-flow-through plug and the channel element. In an embodiment, the non-flow-through plug is one of a wiper plug, a dart, and a ball.

In an embodiment, the alignment of the orifice with the at least one port of the sleeve opens a fluid flow path between the internal bore of the sleeve, the internal channel of the channel element, and the inside of the tubular, and the portion of the channel element covering the at least one port blocks fluid flow between the internal bore of the sleeve, the internal channel of the channel element.

In an embodiment, the orifice can be a set of two or more orifices located around a circumference of the channel element at an axial location on the channel element, and the sleeve can comprise two or more ports, wherein each of the two or more orifices is aligned with one of the two or more ports before the attachment portion breaks.

In an embodiment, the attachment portion comprises at least one shear pin, and the at least one shear pin can extend from an intermediate part positioned between the channel element and an inner surface of the sleeve. In an embodiment, the sleeve can include a receiver portion for receiving a distal end of the channel element, and the receiver portion can include a bottom wall that prevents continual movement of the channel element out of the sleeve after the orifice is out of alignment with the at least one port of the sleeve.

An embodiment of the present invention includes a plug activated mechanical isolation device for controlling fluid flow inside a tubular in a wellbore. The plug activated mechanical isolation device can comprise: a sleeve for coupling to the tubular, wherein the sleeve can include an internal bore and at least one port for fluid flow therethrough; and a channel element positioned in the internal bore of the sleeve, wherein the channel element can include an internal channel and an orifice for fluid flow between the internal channel and the internal bore of the sleeve, and wherein the channel element can be attached to the sleeve via a breakable attachment portion, and the orifice can be aligned with the at least one port of the sleeve. The channel element can be slidable within the sleeve, upon breakage of the breakable attachment portion with a force, to move the orifice out of alignment with the at least one port of the sleeve so that a portion of the channel element covers the at least one port of the sleeve to block fluid flow through the at least one port of the sleeve.

In an embodiment, the alignment of the orifice with the at least one port of the sleeve opens a fluid flow path between the internal bore of the sleeve, the internal channel of the channel element, and the inside of the tubular, and the portion of the channel element covering the at least one port blocks fluid flow between the internal bore of the sleeve, the internal channel of the channel element.

In an embodiment, the orifice can include a set of two or more orifices located around a circumference of the channel element at an axial location on the channel element, the sleeve can comprise two or more ports, and each of the two or more orifices can be aligned with one of the two or more ports before the attachment portion breaks. In an embodiment, the attachment portion can comprise at least one shear pin, and the at least one shear pin can extend from an intermediate part positioned between the channel element and an inner surface of the sleeve.

In an embodiment, the sleeve can include a receiver portion for receiving a distal end of the channel element, and the receiver portion can include a bottom wall that prevents movement of the channel element out of the sleeve after the orifice is out of alignment with the at least one port of the sleeve.

An embodiment of the present invention includes a method of controlling fluid flow inside a tubular in a wellbore, wherein the method comprises: positioning a channel element within an internal bore of a sleeve so that an orifice of the channel element can be aligned with a port of the sleeve, and coupling the sleeve, with the channel element positioned therein, to the tubular. The method can continue by inserting the tubular, including the sleeve and the channel element, into the wellbore, inserting a non-flow-through plug into the tubular, and causing the non-flow-through plug to exert a force onto the channel element with a first predetermined pressure to move the channel element relative to the sleeve so that the orifice of the channel element comes out of alignment with the at least one port of the sleeve and so that a portion of the channel element covers the at least one port of the sleeve.

In an embodiment, the method further comprises: inserting a flow-through plug into the tubular and onto the channel element before the non-flow-through plug is lowered into the wellbore and the tubular, the flow-through plug including a breakable part; and breaking, before the non-flow-through plug is lowered into the wellbore and the tubular, the breakable part with a second predetermined pressure that is less than the first predetermined pressure to allow fluid flow through the first plug and into the channel element after the breakable part breaks, wherein the non-flow-through plug is pressed against the flow-through plug with the first predetermined pressure to move the channel element.

In an embodiment, the channel element can be positioned within the internal bore of a sleeve via a breakable attachment portion, and the first predetermined pressure can break the attachment portion.

In an embodiment, the method can comprise pumping cement into the tubular, wherein the flow-through plug can be inserted into the tubular with the cement, and the cement can break the breakable part of the first plug and can flow through the flow-through plug and into an internal channel of the channel element. In an embodiment, the cement further flows through the orifice of the channel element and the at least one port of the sleeve, into the internal bore of the sleeve, and then out of the sleeve. In an embodiment, the non-flow-through plug is one of a wiper plug, a dart, and a ball.

The foregoing is intended to give a general idea of the embodiments, and is not intended to fully define nor limit the invention. The embodiments will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
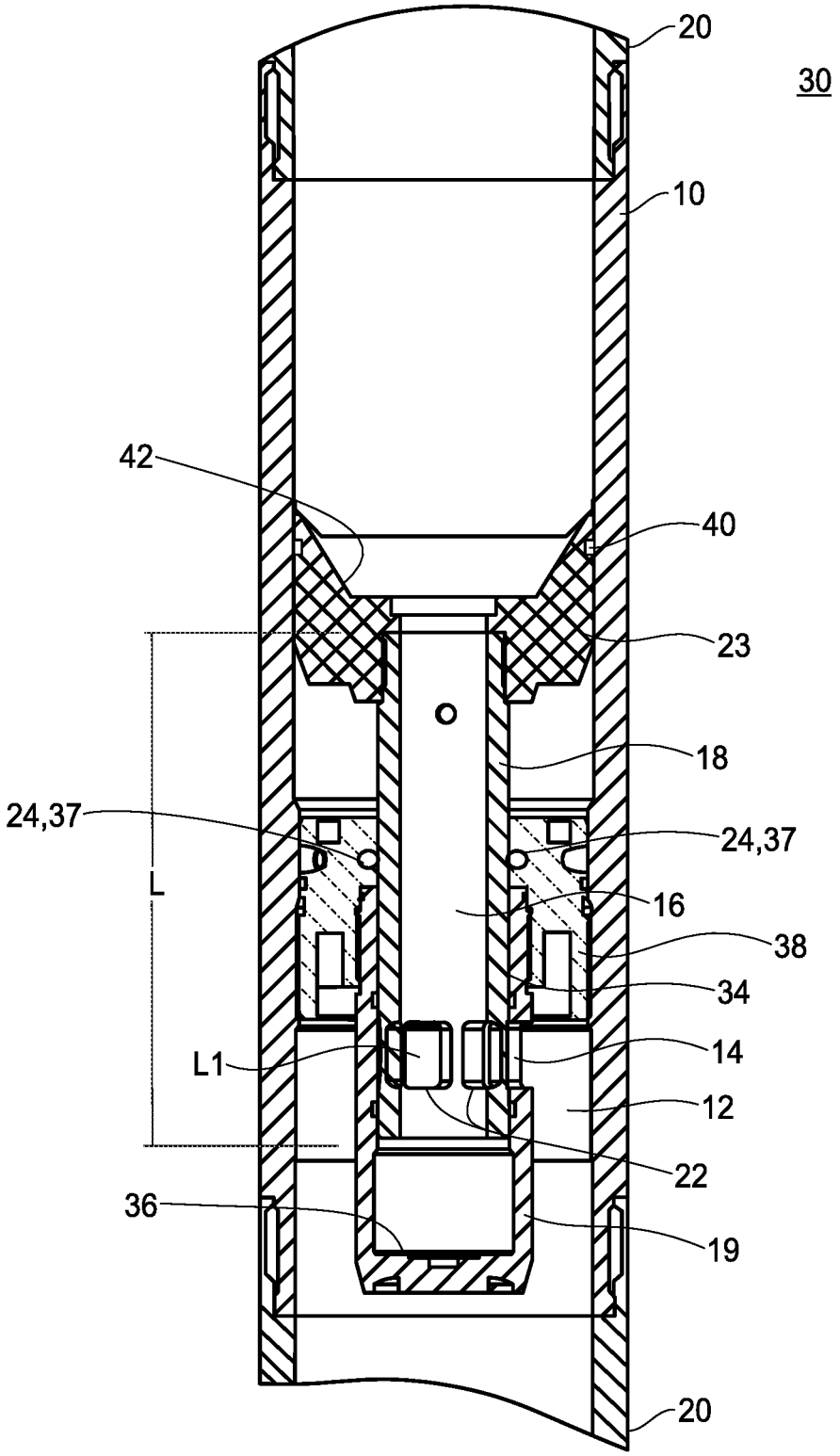
FIG. 1 illustrates a system including a plug activated mechanical isolation device in an "auto-fill" position according to an embodiment.

FIG. 1 illustrates an embodiment of a system including a plug activated mechanical isolation device. In the system, a sleeve 10 is coupled to at least one tubular 20 that is to be inserted into a wellbore 30. The sleeve 10 may be coupled to the tubular 20 via a threaded connection, or with another type of connection known in the oil and gas industry. The tubular 20 can further include a threaded connector at an opposing end for connection to another tubular (not shown). As shown in FIG. 1, the sleeve 10 is threadably connected between two tubulars 20, thus forming a casing string with the tubulars 20 that is run into the wellbore 30. The length of the sleeve 10 is not limited to a particular length, but in one embodiment is 48 inches. In some embodiments, the sleeve 10 may have a pressure rating of up to 10,000 psi, and may have a temperature rating of 450 degrees Fahrenheit.

The sleeve 10 includes an internal bore 12, an intermediate part 38, and a receiver portion 19 within the internal bore 12. The intermediate part 38 may be formed as a single unitary piece with the sleeve 10, or may be a separate component that is fixed in the interior of the sleeve 10, such as to an inner wall of the sleeve 10. The receiver portion 19 may be attached to the intermediate part 38 so that the receiver portion 19 is positioned in a central part of the internal bore 12, i.e., so that a space for fluid flow is provided in the internal bore 12 between the receiver portion 19 and the inner wall of the sleeve 10. The receiver portion 19 includes a port 14 at a sidewall thereof, and includes a bottom wall 36 at a distal end of the receiver portion 19. The receiver portion 19 may comprise a single port 14, or a series of ports 14 around a circumference of the receiver portion 19, as shown in FIG. 1. The port 14, or series of ports 14, allows fluid flow between the internal bore 12 of the sleeve 10 and an inside of the tubular 20 that may be connected to the distal end of the sleeve 10. The sleeve 10 is open at the proximal thereof to receive at least one plug, such as a flow-through plug 26 (see FIG. 2) and a non-flow-through plug 32 (see FIG. 4), and includes the receiver portion 19 near the distal end.

A channel element 18 is positioned in the internal bore 12 of the sleeve 10. The channel element 18 is attached to the intermediate part 38 via a breakable attachment portion 24, so that a portion of the channel element 18 is located in the receiver portion 19. Thus, the sleeve 10, when run in with the tubular 20 or casing/liner, includes the channel element 18 positioned therein. In other words, the tubular 20, the sleeve 10, and the channel element 18 form a unit assembled at the surface for insertion into the wellbore 30. Running the sleeve 10, including the channel element 18 therein, as part of the casing string with the tubulars 20 eliminates the additional step of mechanically setting a packer or bridge plug retainer. In an embodiment, the breakable attachment portion 24 may comprise one or more shear pins 37 extending from the intermediate part 38. The breakable attachment portion 24 is configured to release the channel element 18 from an attached position in the sleeve 10 (as shown in FIG. 1) so that the channel element 18 is movable, relative to the sleeve 10, inside the internal bore 12 as discussed in further detail below.

The channel element 18 has a longitudinal length "L" that extends from one end (i.e., proximal end) of the channel element 18 to an opposite end (i.e., distal end) of the channel element 18. An internal channel 16 of the channel element 18 extends from the proximal end to the distal end. An orifice 22 is located at an axial location L1 on an outer surface of the channel element 18 on the longitudinal length "L". The orifice 22 is provided below a portion 34 (e.g., wall) of the channel element 18. The channel element 18 may have only one orifice 22, or may have a series of orifices 22 around a circumference of the channel element 18 at the axial location L1 on the longitudinal length "L", as shown in FIG. 1. The one end, or proximal end, of the channel element 18 may include a contact sealing portion 23 for receiving one of the flow-through plug 26 or the non-flow-through plug 32, as discussed below. The contact sealing portion 23 may be formed as a single unitary piece with the channel element 18, or may be a separate component that is fixed to a part of the channel element 18. The contact sealing portion 23 includes a seat 42 for creating a seal with a surface of the flow-through plug 26/non-flow-through plug 32 (see FIG. 3). In an embodiment, a seal 40, such as a sealing ring, may be provided on the contact sealing portion 23 to contact the inner wall of the sleeve 10. The contact sealing portion 23 may be formed of a steel composition.

As shown in FIG. 1, the receiver portion 19 includes an opening for receiving the portion of the channel element 18 that has the orifice (or orifices) 22. When attached inside of the sleeve 10 via the breakable attachment portion 24, the orifice (or orifices) 22 is aligned with the port (or ports) 14 in the receiver portion 19 to provide a fluid flow path between the internal bore 12 of the sleeve 10 and the internal channel 16 of the channel element 18.

The sleeve 10 and the channel element 18 may each be formed of a material that is drillable upon completion of a cementing operation, in case completion of the wellbore 30 requires a depth greater than the location of the sleeve 10. In one embodiment, the material is cast iron. Other materials include plastic composites, aluminum or other metals, and any other materials that can be used in the well profile design.

FIG. 1 shows the "auto-fill" position of the plug activated mechanical isolation device. The "auto-fill" position may be the position of the plug activated mechanical isolation device when the device is run in with the tubular 20 or casing/liner into the wellbore 30. The "auto-fill" position is before the flow-through plug 26 or non-flow-through plug 32 is inserted into the casing string onto the plug activated mechanical isolation device, and before a fluid, such as cement, is pumped into the tubular 20 and though the device in a pumping operation (discussed below). In the "auto-fill" position, the channel element 18 is positioned within the sleeve 10 so that at least the portion of the channel element 18 having the orifice (or orifices) 22 is within the opening of the receiver portion 19. In that position, the orifice (or orifices) 22 is aligned with the port (or ports) 14 of the receiver portion 19. The alignment of the orifice (or orifices) 22 with the port (or ports) 14 allows well fluid, such as hydrocarbons, to flow between the internal bore 12 of the sleeve 10, the port (or ports) 14 of the sleeve 10, the orifice (or orifices) 22 of the channel element 18, and the internal channel 16 of the channel element 18.

Figure 2:
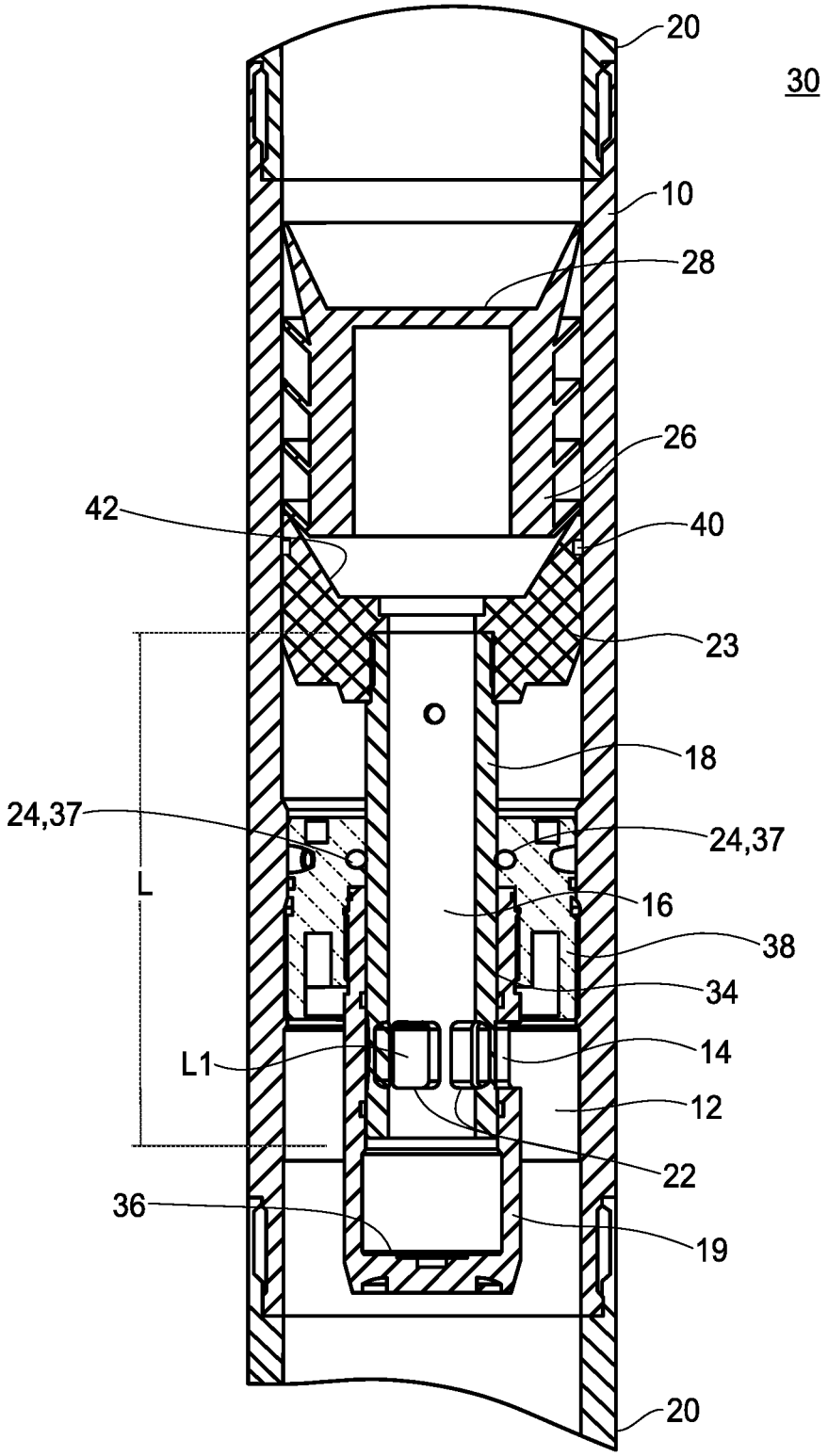
FIG. 2 illustrates a system including a flow-through plug with the plug activated mechanical isolation device according to an embodiment.
Figure 3:
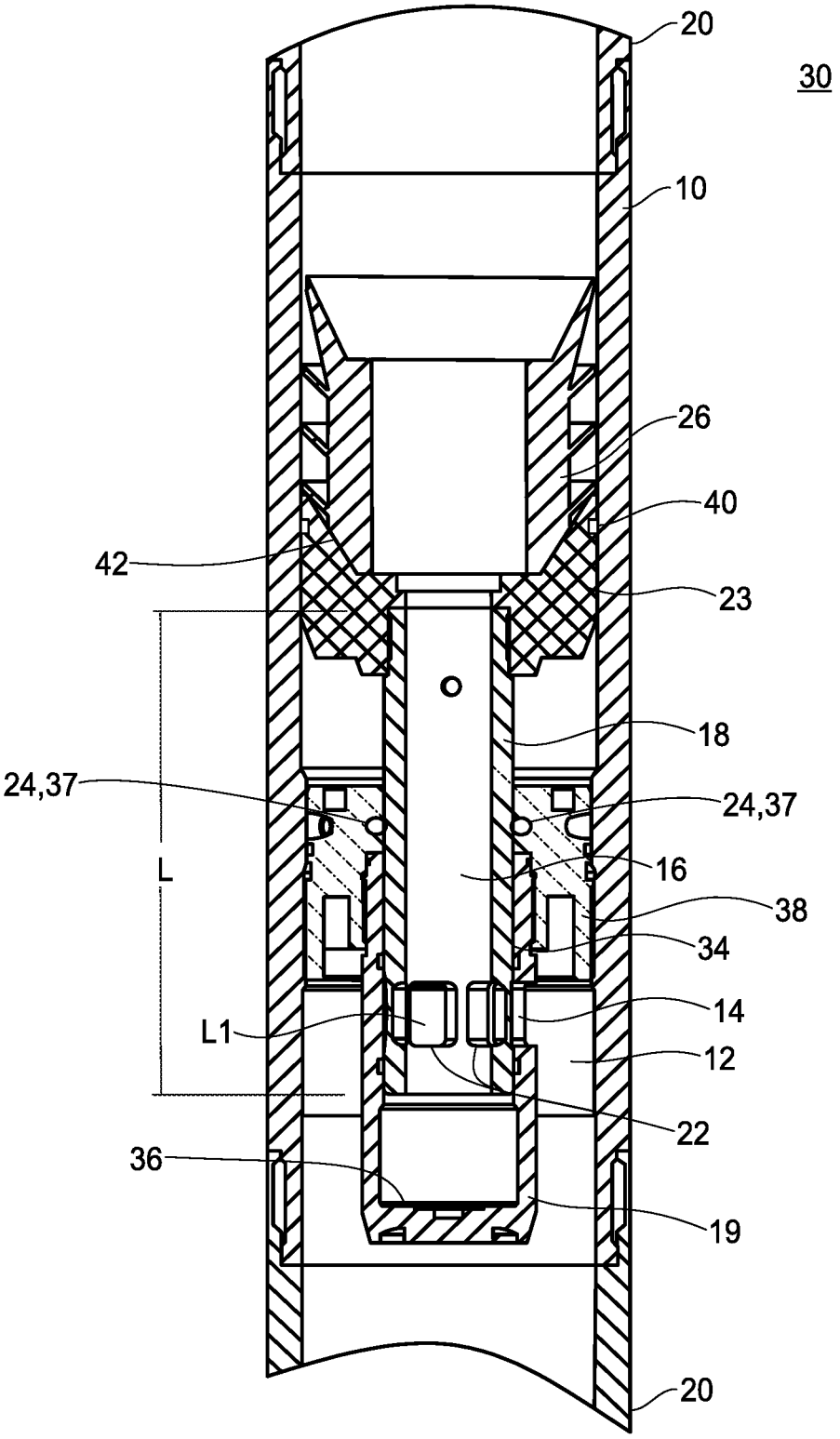
FIG. 3 illustrates a system in which the plug activated mechanical isolation device in a "pumping" position according to an embodiment.

FIG. 2 shows the flow-through plug 26 inserted into the sleeve 10. Inserting the flow-through plug 26 is part of the "pumping" position according to a preferred embodiment. In particular, once the casing string, including the tubular 20 having the mechanical isolation device (i.e., the channel element 18 positioned inside the sleeve 10), is positioned in the wellbore 30, the flow-through plug 26 is inserted into the wellbore 30 and into the tubular 20. The flow-through plug 26 may be a wiper plug, but is not limited thereto. The flow-through plug 26 may inserted into the wellbore 30 as part of a material flow, such as a cementing operation, in which the flow-through plug 26 is provided at the tip of the material that is pumped into the casing string. The pumping action moves the flow-through plug 26 through the casing string until the flow-through plug 26 contacts the contact sealing portion 23 of the channel element 18. The contact sealing portion 23 of the channel element 18 stops further movement of the flow-through plug 26 when the flow-through plug 26 contacts the seat 42 of the contact sealing portion 23 and creates a sealing connection with the seat 42 of the contact sealing portion 23, as shown in FIG. 3. The flow-through plug 26 includes a breakable part 28, shown in FIG. 2, which is configured to break under a predetermined pressure from the material flow. For instance, the first predetermined pressure may be in the range of 500 to 1,000 psi.

When the breakable part 28 breaks under the predetermined pressure, the material (e.g., cement) is allowed to flow through the interior of the flow-through plug 26 and into the internal channel 16 of the channel element 18. Thus, breakage of the breakable part 28 puts the plug activated mechanical isolation into the "pumping" position shown in FIG. 3. Note that in FIG. 3, the breakable part 28 is broken, and thus not shown. The "pumping" position opens a path that allows the material, such as cement, to flow through the flow-through plug 26, into the internal channel 16 of the channel element 18, through the orifice 22 of the channel element 18 and the at least one port 14 of the sleeve 10, into the internal bore 12 of the sleeve 10, and then out of the sleeve 10.

Figure 4:
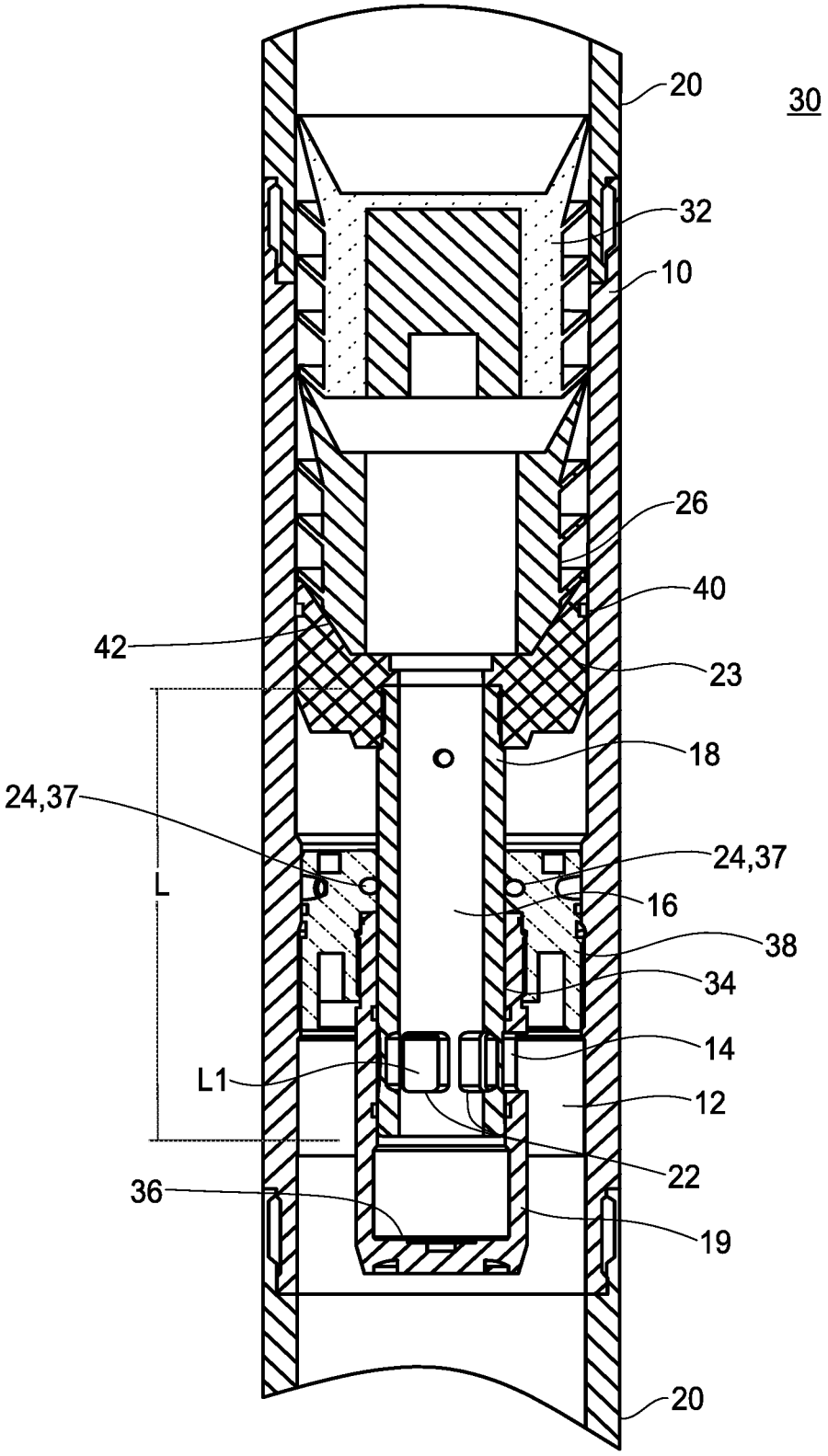
FIG. 4 illustrates a system including a flow-through plug and a non-flow-through plug with the plug activated mechanical isolation device according to an embodiment.
Figure 5:
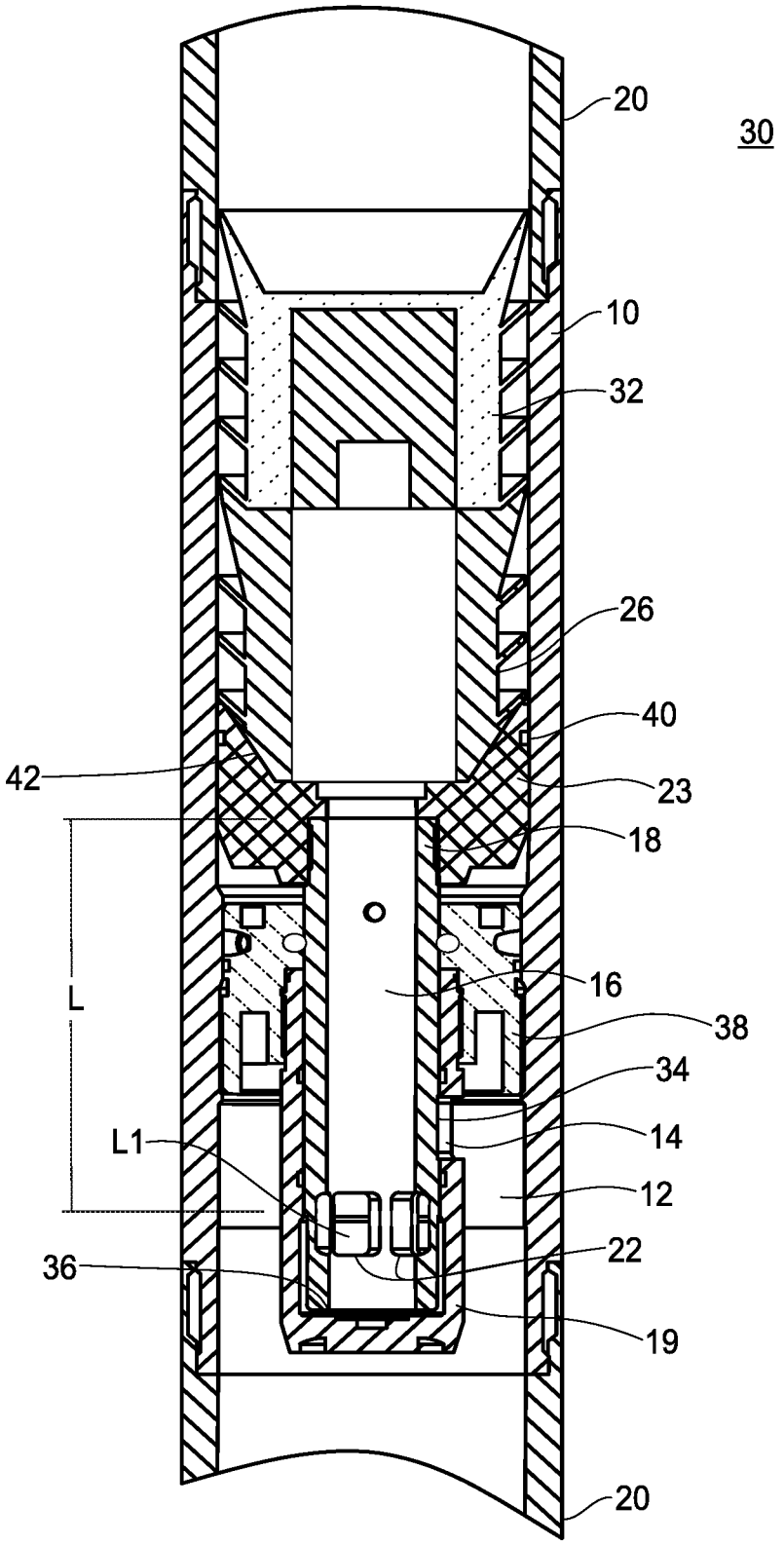
FIG. 5 illustrates a system in which the plug activated mechanical isolation device in the "closed" position according to an embodiment.

Once the pumping procedure is completed, the plug activated mechanical isolation device may be moved from the "pumping" position to the "closed" position, which is illustrated in FIGS. 4 and 5. To obtain the "closed" position, a non-flow-through plug 32 is lowed into the wellbore 30 and the tubular 20 (see FIG. 3). In this process, the non-flow-through plug 32 may be provided at the tip of displacement fluid that is pumped into the wellbore 30 after a cementing operation is completed. The pumping action moves the non-flow-through plug 32 through the casing string and tubular 20 coupled to the sleeve 10 until the non-flow-through plug 32 is pressed against the flow-through plug 26 as shown in FIG. 4. The pumping action produces a second predetermined pressure on the non-flow-through plug 32. The second predetermined pressure is greater than the predetermine pressure for breaking the breakable portion 28 of the flow-through plug 26. The second predetermined pressure causes the non-flow-through plug 32 to press against the flow-through plug 26 which, in turn, presses against the channel element 18 with a force strong enough to break the attachment portion 24 of the channel element 18 with the intermediate part 38. Breaking the attachment portion 24 releases the channel element 18 form its initial position in the "auto-fill" and "pumping" positions. The second predetermined pressure is greater than the predetermined pressure for breaking the breakable portion 28 of the flow-through plug 26, which may be in the range of range of 500 to 1,000 psi, as discussed above. The strength of the attachment portion 24 must be greater than the strength of the breakable part 28 of the flow-through plug 26 so that the predetermined pressure that is applied to break the breakable part 28 does not prematurely break the attachment portion 24 and un-align the orifice 22 of the channel element 18 and the at least one port 14 of the sleeve 10 during the cementing operation.

As discussed, the force provided by the predetermined pressure from pumping breaks the attachment portion 24 between the channel element 18 and the sleeve 10, and releases the channel element 18 so that the channel element 18 moves relative to the sleeve 10. The movement causes the distal end of the channel element 18 to move to toward the bottom wall 36 of the receiver portion 19, which in turn moves the orifice 22 of the channel element 18 out of alignment with the at least one port 14 of the sleeve 10, as shown in FIG. 5. Moving the orifice 22 of the channel element 18 out of alignment with the at least one port 14 of the sleeve 10 positions a portion 34, such as a wall, of the channel element 18 over the at least one port 14 of the sleeve 10 to cover the at least one port 14 (see FIG. 5). In this "closed" position, the portion 34, or wall, of the channel element 18 blocks flow between the internal channel 16 of the channel element 18 and the internal bore 12 of the sleeve 10, so that fluid in the internal bore of the tubular 20 is prohibited from flowing though the plug activated mechanical isolation device. In the "closed" position, the channel element 18 may abut against the bottom wall 36 of the receiver portion 19 to prevent further movement of the channel element 18 and maintain the channel element 18 within the sleeve 10.

In an alternative embodiment, the plug activated mechanical isolation device is actuated via a single plug. As used herein, the plug may be a wiper plug, a dart, or a ball. However, the disclosure is not limited to only these plugs, and other plugs known in the art may be used to activate the plug activated mechanical isolation device. While a ball is dropped into the casing string, the wiper plug and the dart are typically pumped into the casing string. In the alternative embodiment, the plug activated mechanical isolation is run in with the tubular 20/casing string in the "auto-fill" position, as discussed above. An example of the "auto-fill" position is shown in FIG. 1. In the absence of any plug in the casing string above the plug activated mechanical isolation device, cement may then be pumped through the casing string and through the open internal channel 16 of the channel element 18. In this case, the "auto-fill" position may also constitute the "pumping" position. That is, the cement is able to pass through the aligned at least one port 14 of the sleeve 10, into the internal bore 12 of the sleeve 10, out of the sleeve 10, and then out through the bottom of the casing string to fill the annulus adjacent the outer surface of the casing string.

In this alternative embodiment, a plug, such as a wiper plug, a dart, or a ball, is then inserted into the tubular 20. In the case of a dart or wiper plug, the plug may be provided at the tip of displacement fluid. The plug presses against the channel element 18 with a force strong enough to break the attachment portion 24 of the channel element 18 with the intermediate part 38 and move the channel element 18 form its initial position in the internal bore 12 of the sleeve 10. Movement of the channel element 18 under the influence of the force moves the channel element 18 relative to the sleeve 10 so that the orifice 22 comes out of alignment with the at least one port 14 of the sleeve 10, resulting in a portion 34, or wall, of the channel element 18 covering the at least one port 14 of the sleeve 10. In this "closed" position, the portion 34, or wall, blocks flow between the internal bore 12 of the sleeve 10 and the internal channel 16 of the channel element 18, so that fluid in the internal bore of the tubular 20 is prohibited from flowing though the plug activated mechanical isolation device.

A preferred method of controlling fluid flow inside a tubular 20 in a wellbore 30 is described below. The method is apparent from the embodiments shown in FIGS. 1-5, and may involve one or more of the aspects of one or more of the embodiments discussed herein. Generally, the method includes positioning the channel element 18 within the internal bore 12 of a sleeve 10 so that the orifice 22 of the channel element 18 is aligned with the port 14 of the sleeve 10. The sleeve 10 (and accompanying channel element 18) is then coupled to the tubular 20. The tubular 20, the sleeve 10, and the channel element 18 thus form a unit assembled at the surface for insertion into the wellbore 30. The tubular 20 (including therein the sleeve 10 and the channel element 18) is then attached to a casing string and inserted into the wellbore 30 in the "auto-fill" position, as shown in FIG. 1.

Next, the flow-through plug 26 is inserted into the tubular 20 as, for example, part of a material flow, such as a cementing operation, in which the flow-through plug 26 is provided at the tip of the material that is pumped into the wellbore 30. The pumping action moves the flow-through plug 26 through the casing string until the flow-through plug 26 contacts the contact seat 40 of the sealing portion 23 of the channel element 18, as shown in FIG. 3. Continued pumping action of the material flow exerts a predetermined pressure on the flow-through plug 26 that breaks the breakable part 28 of the flow-through plug 26 and allows fluid flow through the flow-through plug 26 and into the internal channel 16 of the channel element 18, so that the plug activated mechanical isolation device is in the "pumping" position in the preferred embodiment. In the "pumping" position, cement may be pumped through the flow-through plug 26, into the internal channel 16 of the channel element 18, through the orifice 22 of the channel element 18 and the aligned at least one port 14 of the sleeve 10, into the internal bore 12 of the sleeve 10, out of the sleeve 10, and then out through the bottom of the casing string to fill the annulus adjacent the outer surface of the casing string.

After the pumping procedure is completed, the plug activated mechanical isolation device is placed in the "closed" position by inserting the non-flow-through plug 32 into the tubular 20, as shown in FIG. 4. The non-flow-through plug 32 may be provided at the tip of displacement fluid that is pumped into the casing string. The pumping action moves the non-flow-through plug 32 through the casing string until the non-flow-through plug 32 is pressed against the flow-through plug 26 under another predetermined pressure that is greater than the predetermined pressure to break the breakable portion 24. This greater predetermined pressure causes the non-flow-through plug 32 to press against the flow-through plug 26, which, in turn, causes the flow-through plug 26 to press against the channel element 18 with a force strong enough to break the attachment portion 24 of the channel element 18 with the intermediate part 38 and move the channel element 18 form its initial position in the internal bore 12 of the sleeve 10. Movement of the channel element 18 under the influence of the force moves the channel element 18 relative to the sleeve 10 so that the orifice 22 comes out of alignment with the at least one port 14 of the sleeve 10, resulting in a portion 34, or wall, of the channel element 18 covering the at least one port 14 of the sleeve 10, as shown in FIG. 5. In this "closed" position, the portion 34, or wall, blocks flow between the internal bore 12 of the sleeve 10 and the internal channel 16 of the channel element 18, so that fluid in the internal bore of the tubular 20 is prohibited from flowing though the plug activated mechanical isolation device.

Because the plug activated mechanical isolation device is installed and run in with the casing/liner string, the conventional processes associated with mechanically setting a packer/bridge plug cement retainer with drill pipe or wireline are eliminated. Further, because the plug activated mechanical isolation device can be activated (or closed) via plugs at the tip of material flows, an extra pipe trip to access and actuate a valve also is eliminated. Moreover, the plug activated mechanical isolation device, systems and methods discussed herein eliminate extra wiper/cleanout trips needed for proper installation of packer/bridge plug cement retainers, and allow for timely displacement of fluids with completion fluids. Multiple trips down the casing string to access and actuate a valve, as in conventional cementing jobs, can be avoided. The mechanical isolation device thus provides significant time (and cost) savings during cementing operations. Further, because the channel element 18 is installed in the sleeve 10 and inserted in the tubular 20 at the surface, there is no need for a drillable packer/bridge plug cement retainers which take multiple rig operations to properly install.

Additionally, after the cement pumping operation, cement below the plug activated mechanical isolation device is isolated from pressure and fluid above the valve. Downhole pressure control is thus provided both above and below the plug activated mechanical isolation device, allowing for positive and negative testing of the annulus and the liner/casing during installation without having to install a separate breech plug or cement retainer in another trip down the casing string.

While various embodiments usable within the scope of the present disclosure have been described with emphasis, it should be understood that within the scope of the appended claims, the present invention may be practiced other than as specifically described herein.

What is claimed is:

1. A system for controlling fluid flow inside a tubular in a wellbore, comprising:

the tubular;

a sleeve coupled to the tubular, wherein the sleeve comprises an internal bore and a receiver portion including at least one port for fluid flow therethrough;

a channel element positioned in the internal bore of the sleeve, wherein the tubular, the sleeve and the channel element form a unit for insertion into the wellbore, wherein the channel element comprises an internal channel and an orifice for fluid flow between the internal channel and the internal bore of the sleeve, wherein the channel element is attached to the sleeve via a breakable attachment portion that is located on an intermediate part disposed between the channel element and the sleeve, wherein the receiver portion is attached to the intermediate part in a central part of the internal bore so that a space for fluid flow is provided in the internal bore between the receiver portion and an inner surface of the sleeve, and wherein the orifice is aligned with the at least one port of the sleeve; and a non-flow-through plug, wherein the non-flow-through plug is lowered into the wellbore and the tubular and exerts a force onto the channel element, wherein the force breaks the attachment portion under a first predetermined pressure and moves the channel element relative to the sleeve to move the orifice out of alignment with the at least one port of the sleeve so that a portion of the channel element covers the at least one port of the sleeve.

2. The system according to claim 1, further comprising a flow-through plug that is lowered onto the channel element before the non-flow-through plug is lowered into the wellbore and the tubular, wherein the flow-through plug comprises a breakable part that breaks under a second predetermined pressure, wherein the second predetermined pressure is less than the first predetermined pressure to allow fluid flow through the flow-through plug and into the internal channel after the breakable part breaks, wherein the flow-through plug is positioned between the non-flow-through plug and the channel element.

3. The system according to claim 1, wherein the alignment of the orifice with the at least one port of the sleeve opens a fluid flow path between the internal bore of the sleeve, the internal channel of the channel element, and the inside of the tubular, wherein the portion of the channel element covering the at least one port blocks fluid flow between the internal bore of the sleeve and the internal channel of the channel element.

4. The system according to claim 1, wherein the orifice is a set of two or more orifices located around a circumference of the channel element at an axial location on the channel element, wherein the sleeve comprises two or more ports, and wherein each of the two or more orifices is aligned with one of the two or more ports before the attachment portion breaks.

5. The system according to claim 1, wherein the attachment portion comprises at least one shear pin.

6. The system according to claim 5, wherein the at least one shear pin extends from the intermediate part.

7. The system according to claim 1, wherein the receiver portion receives a distal end of the channel element, and wherein the receiver portion comprises a bottom wall that prevents continual movement of the channel element out of the sleeve after the orifice is out of alignment with the at least one port of the sleeve.

8. The system according to claim 1, wherein the non-flow-through plug is one of a wiper plug, a dart, and a ball.

9. A plug activated mechanical isolation device for controlling fluid flow inside a tubular in a wellbore, comprising:

a sleeve for coupling to the tubular, wherein the sleeve comprises an internal bore and a receiver portion including at least one port that allows fluid flow therethrough; and a channel element positioned in the internal bore of the sleeve, wherein the channel element comprises an internal channel and an orifice for fluid flow between the internal channel and the internal bore of the sleeve, wherein the channel element is attached to the sleeve via a breakable attachment portion that is located on an intermediate part disposed between the channel element and the sleeve, wherein the receiver portion is attached to the intermediate part in a central part of the internal bore so that a space for fluid flow is provided in the internal bore between the receiver portion and an inner surface of the sleeve, wherein the orifice is aligned with the at least one port of the sleeve, and wherein the channel element is slidable within the sleeve, when a force breaks the breakable attachment portion, to move the orifice out of alignment with the at least one port of the sleeve such that a portion of the channel element covers the at least one port of the sleeve and blocks fluid flow through the at least one port of the sleeve.

10. The plug activated mechanical isolation device according to claim 9, wherein the alignment of the orifice with the at least one port of the sleeve opens a fluid flow path between the internal bore of the sleeve, the internal channel of the channel element, and the inside of the tubular, and wherein the portion of the channel element covering the at least one port blocks fluid flow between the internal bore of the sleeve and the internal channel of the channel element.

11. The plug activated mechanical isolation device according to claim 9, wherein the orifice comprises a set of two or more orifices located around a circumference of the channel element at an axial location on the channel element, wherein the sleeve comprises two or more ports, and wherein each of the two or more orifices is aligned with one of the two or more ports before the attachment portion breaks.

12. The plug activated mechanical isolation device according to claim 9, wherein the attachment portion comprises at least one shear pin.

13. The plug activated mechanical isolation device according to claim 12, wherein the at least one shear pin extends from the intermediate part.

14. The plug activated mechanical isolation device according to claim 9, wherein the receiver portion receives a distal end of the channel element, and wherein the receiver portion comprises a bottom wall that prevents movement of the channel element out of the sleeve after the orifice is out of alignment with the at least one port of the sleeve.

15. A method of controlling fluid flow inside a tubular in a wellbore, comprising:

positioning a channel element within an internal bore of a sleeve via a breakable attachment portion that is located on an intermediate part disposed between the channel element and the sleeve, such that an orifice of the channel element is aligned with a port on a receiver portion of the sleeve and the receiver portion is attached to the intermediate part in a central part of the internal bore so that a space for fluid flow is provided in the internal bore between the receiver portion and an inner surface of the sleeve;

coupling the sleeve, with the channel element positioned therein, to the tubular;

inserting the tubular, comprising the sleeve and the channel element, into the wellbore;

inserting a non-flow-through plug into the tubular; and moving the channel element relative to the sleeve with a force exerted by the non-flow-through plug onto the channel element with a first predetermined pressure so that the orifice of the channel element moves out of alignment with the at least one port of the sleeve and a portion of the channel element covers the at least one port of the sleeve.

16. The method according to claim 15, further comprising:

inserting a flow-through plug into the tubular and onto the channel element before the non-flow-through plug is lowered into the wellbore and the tubular, wherein the flow-through plug comprises a breakable part; and breaking, before the non-flow-through plug is lowered into the wellbore and the tubular, the breakable part with a second predetermined pressure that is less than the first predetermined pressure to allow fluid flow through the flow-through plug and into the channel element, wherein the non-flow-through plug is pressed against the flow-through plug with the first predetermined pressure to move the channel element.

17. The method according to claim 16, further comprising pumping cement into the tubular, wherein the steps comprise:

inserting the flow-through plug into the tubular with the cement, and breaking the breakable part of the first plug with the cement, wherein the cement flows through the flow-through plug into an internal channel of the channel element.

18. The method according to claim 17, wherein the cement further flows through the orifice of the channel element and the at least one port of the sleeve, into the internal bore of the sleeve, and out of the sleeve.

19. The method according to claim 15, wherein the first predetermined pressure breaks the attachment portion.

20. The method according to claim 15, wherein the non-flow-through plug is one of a wiper plug, a dart, and a ball.

* * * * *